US006042660A

United States Patent [19]

Boone et al.

[11] Patent Number: 6,042,660

[45] Date of Patent: Mar. 28, 2000

[54] STRONTIUM MASTER ALLOY COMPOSITION HAVING A REDUCED SOLIDUS TEMPERATURE AND METHOD OF MANUFACTURING THE SAME

[75] Inventors: Gary W. Boone, Henderson, Ky.; Philip G. Vais, Columbus, Ohio; Daniel B. Franklin, Hanson, Ky.

[73] Assignee: KB Alloys, Inc., Sinking Springs, Pa.

[21] Appl. No.: 09/093,506

[22] Filed: Jun. 8, 1998

[51] Int. Cl.[7] ..... C21D 1/09

[52] U.S. Cl. ..... 148/538; 148/539; 148/551; 148/441; 148/442; 75/324; 75/952

[58] Field of Search ..... 148/538, 539, 148/551, 441, 442; 420/515, 521; 75/324, 952

[56] References Cited

U.S. PATENT DOCUMENTS

| | | | |
|---|---|---|---|
| 3,915,693 | 10/1975 | Rasmussen | 75/304 |
| 3,926,690 | 12/1975 | Morris et al. | 148/439 |
| 4,009,026 | 2/1977 | Rasmessen | 420/459 |
| 4,108,646 | 8/1978 | Gennone et al. | 420/459 |
| 4,185,999 | 1/1980 | Seese et al. | 420/459 |
| 4,394,348 | 7/1983 | Hardy et al. | 420/528 |
| 4,576,791 | 3/1986 | Thistlethwaite | 420/552 |
| 4,937,044 | 6/1990 | Closset | 420/415 |
| 5,045,110 | 9/1991 | Vader et al. | 75/338 |
| 5,143,564 | 9/1992 | Grazleski et al. | 148/420 |
| 5,205,986 | 4/1993 | Noordegraaf et al. | 420/528 |
| 5,230,754 | 7/1993 | Setzer et al. | 148/437 |

FOREIGN PATENT DOCUMENTS

91/05069 4/1991 WIPO .

OTHER PUBLICATIONS

G. Bruzzone: "The Sr–Zn System" Journal of the Less–Common Metals, vol. 92, 1983, pp. 75–79, XP002109984.

F. Sommer et al.: "Neue glasartige Legierungen", vol. 69, 1987, pp. 587–590. XP002109985, Dr. Riederer Verlag GmbH.

Modification of Intermetallic Phases by Strontium in Aluminum Wrought Alloys, by M.H. Mulazimoglu et al., Light Metals—pp1047–56, Light Metals 1994, Edited by U. Mannweiler, The Minerals, Metals & Materials Society, 1994.

*Primary Examiner*—Sikyin Ip

*Attorney, Agent, or Firm*—Bachman & LaPointe, P.C.

[57] ABSTRACT

Master alloy with 20–80% strontium, preferably 0.01–2.0% of aluminum and/or copper, and the balance essentially zinc plus impurities, and a method for preparing same and a method for modifying the microstructure of nonferrous alloys with said master alloy.

12 Claims, No Drawings

STRONTIUM MASTER ALLOY COMPOSITION HAVING A REDUCED SOLIDUS TEMPERATURE AND METHOD OF MANUFACTURING THE SAME

BACKGROUND OF THE INVENTION

The present invention relates to a strontium containing master alloy and its manufacture and use for the control of the microstructure in aluminum, zinc and magnesium base alloys.

Strontium is known in the art to be a superior and permanent modifier of the aluminum-silicon component of eutectic and hypoeutectic, i.e., less than 12.6 weight percent silicon, aluminum-silicon casting alloys. The addition of strontium modifies the morphology of the eutectic phase to produce a fine, fibrous microstructure, rather than the lamellar or acicular plate-like structure typically encountered in unmodified alloys, thus resulting in an alloy with improved mechanical properties, ductility and impact resistance. Reference should be had, for example, to U.S. Pat. Nos. 3,446,170 and 3,567,429, Canadian Patent 1,829,816, and K. Alker et al. "Experiences with the Permanent Modification of Al—Si Casting Alloys", published in *Aluminum,* 49(5), 362–367 (1972).

Other alloy systems have found benefits from additions of strontium as well. For example, U.S. Pat. No. 3,926,690 to Morris et al. discloses that the addition of 0.01–0.5% strontium or calcium to an alloy of aluminum-magnesium-silicon provides an alloy with improved extrusion properties. U.S. Pat. No. 4,394,348 to Hardy et al. discloses that the use of a master alloy containing strontium peroxide provided for a finer grain alloy. In "Modification of Intermetallic Phases by Strontium in Aluminum Wrought Alloys", by M. H. Mulzimoglu et al., strontium additions were reported to have a modifying effect on various intermetallic phases of aluminum series alloys 6061, 5182 and 1xxx.

However, there is difficulty involved in the addition of strontium. Strontium is generally added to alloys in the form of a master alloy. The use of pure metallic strontium is limited in that it readily oxidizes in a humid atmosphere and the presence of the oxide layer inhibits the rate of dissolution of the strontium into the desired melt.

In present practice, such strontium additions to alloys are often done utilizing a strontium containing master alloy. Powder compacts containing strontium-silicon are disclosed in U.S. Pat. No. 4,108,646. British Patent 1,520,673 discloses a master alloy of aluminum-silicon-strontium. A strontium-silicon-aluminum master alloy is disclosed in U.S. Pat. No. 4,009,026. U.S. Pat. No. 4,937,044 describes a strontium-magnesium-aluminum master alloy. The majority of strontium-containing master alloys used for modification of aluminum-silicon alloys are manufactured in the form of binary aluminum-strontium master alloys; however, these have disadvantages, and other systems as well have disadvantages.

Thus, for example, the use of these master alloys has always been hindered by slow melting or dissolution rates in low temperature applications. The following illustrative master alloys all reportedly require addition at melt temperatures in excess of 725° C. in order to achieve acceptable dissolution rates and strontium recovery:

(1) master alloy containing 10 weight percent strontium and 90 weight percent aluminum;

(2) master alloy containing 10 weight percent strontium, 14 weight percent silicon and 76 weight percent aluminum;

(3) master alloy containing 90 weight percent strontium and 10 weight percent aluminum; and (4) master alloy containing 40 weight percent strontium, 35 weight percent aluminum and 25 weight percent magnesium.

In addition, pure metallic strontium, as well as master alloys containing high concentrations of alpha phase strontium, such as 90 weight percent strontium and 10 weight percent aluminum, are very reactive with the atmosphere and require special packaging to prevent oxidation and degradation of the master alloy. This special packaging is usually aluminum which has a liquidus temperature of 660° C., which further hinders the master alloys melting or dissolution rate at lower temperatures.

Many applications utilizing nonferrous alloys operate with the molten metal bath at extremely low temperatures. As an example, molten metal temperatures of 620° C. are common in die casting operations. Also, steel coating lines applying a coating containing 57.5% aluminum, 41% zinc and 1.5% silicon typically operates with a molten metal bath temperature of 600° C. A significant need, therefore, exists in industry for a strontium containing master alloy which would readily melt or dissolve at lower metal temperatures and which is nonreactive and stable in the atmosphere in order to avoid processing difficulties and the necessity for special protective packaging.

SUMMARY OF THE INVENTION

It is therefore a principal object of the present invention to provide a strontium containing master alloy for use as a strontium additive to nonferrous alloy systems, and also to provide a method for modifying the microstructure of nonferrous alloys with said master alloy, and a method for preparing said alloys.

It is a further object of the present invention to provide a master alloy and method as aforesaid wherein said alloy has a low solidus temperature and rapid dissolution rate in molten metal.

It is a still further object of the present invention to provide a method and master alloy as aforesaid for addition of said master alloy to molten nonferrous alloys at bath temperatures below about 700° C., and below about 660° C., and even below about 600° C.

It is a still further object of the present invention to provide a method and master alloy as aforesaid, wherein said master alloy has a relatively high density, which upon addition to the molten bath promotes submergence below the surface of the molten bath, thus minimizing the loss of strontium due to oxidation.

It is an additional object of the present invention to provide a method and master alloy as aforesaid wherein said master alloy is not subject to oxidation and degradation when exposed to moisture and normal atmospheric conditions.

An additional object of the present invention is to provide a method and master alloy as aforesaid wherein the master alloy does not require protective packaging.

It is an additional object of the present invention to provide a method and master alloy as aforesaid wherein the master alloy can be cast into conventional ingot and button type products, and wherein the master alloy has low ductility which enables same to be further processed into granules or powder.

A further object of the present invention is to provide a method and master alloy as aforesaid wherein the master alloy can be provided in many forms for addition to molten nonferrous alloys, as (a) ingot, (b) button, (c) shot, (d) granule, (e) powder, (f) compacts or briquettes of granules or powder, (g) powder for injection or mold coating, and (h) cored wire or rod.

In accordance with the present invention, it has now been found that the foregoing objects and advantages of the present invention can be readily obtained.

The master alloy of the present invention consists essentially of in weight percent between 20–80% strontium, desirably between 30 and 40 weight percent strontium, with the balance being zinc plus impurities. Preferably, the master alloy also includes in weight percent from 0.01–2.0% each of a material selected from the group consisting of aluminum and copper and mixtures thereof, and preferably from 0.1 to 0.5% each of said material.

Throughout the present specification all percentages are by weight.

The present invention also relates to a method for modifying the microstructure of nonferrous alloys by providing a melt of an alloy selected from the group consisting of aluminum base alloys, magnesium base alloys and zinc base alloys, and adding the aforesaid master alloy thereto.

The present invention also relates to a process for preparing a master alloy, which comprises: preparing a master alloy consisting essentially of between 20–80% strontium, with the balance being zinc plus impurities; including the steps of providing a molten metal bath containing zinc and from 0.01–2.0% each of a material selected from the group consisting of aluminum, copper and mixtures thereof; and adding the requisite amount of strontium to the molten metal bath, thereby reducing losses due to oxidation. Desirably, the strontium is added to the molten metal bath after the addition of said material thereto.

Further objects and advantages of the present invention will appear hereinbelow.

DETAILED DESCRIPTION OF PREFERRED EMBODIMENTS

In accordance with the present invention, the master alloy contains 20–80% strontium and preferably 30–40% strontium. In addition, the master alloy desirably contains from 0.01–2.0% of aluminum and/or copper, and preferably from 0.1–0.5% of aluminum and/or copper. Strontium-zinc master alloys containing more than 40% strontium are reactive with the atmosphere and in the absence of special packaging suffer degradation over time. Strontium-zinc master alloys with less than 30% strontium have increased liquidus and solidus temperature properties. The addition of aluminum and/or copper as aforesaid minimizes oxidation and dross generation during the manufacture and casting of the master alloy and provides a master alloy having minimal reactivity with the atmosphere and requires no special protective packaging to prevent degradation.

The master alloy of the present invention modifies the microstructure of nonferrous alloys such as aluminum, magnesium and zinc base alloys by adding the master alloy to a molten metal bath of the nonferrous alloy.

The master alloy of the present invention particularly modifies the aluminum-silicon eutectic component in aluminum-silicon eutectic and hypoeutectic casting alloys, and also modifies the silicon eutectic phase in aluminum-zinc-silicon alloys. Thus, the eutectic component is modified to produce a fine, fibrous microstructure.

In addition, in aluminum base wrought and casting alloys, the master alloy of the present invention modifies the plate-like beta $Al_5FeSi$ phase to the Chinese scrip alpha $Al_8Fe_2Si$ phase, and changes the morphology of the $Mg_2Si$ phase from Chinese scrip to needle-like form.

In addition, in secondary aluminum casting alloys, the master alloy of the present invention reduces the size of sludge particles, i.e., the complex Fe-bearing intermetallic phase present in these alloys.

Still further, the master alloy of the present invention reduces the grain size and concentrates shrinkage microporosity in magnesium base alloys.

In accordance with the process of the present invention, a master alloy containing between 20–80% strontium, with the balance being zinc plus impurities, is prepared by providing a molten metal bath containing zinc and from 0.01–2.0% each of aluminum and/or copper, and adding the requisite amount of strontium to the molten metal bath. Desirably, the aluminum and/or copper is added to the molten metal bath before the addition of the strontium.

Advantageously, the foregoing procedure reduces oxidation on top of the melt and reduces strontium losses due to oxidation. Also, when the alloy is cast, it has been found that the present process again reduces oxidation on the surface of the resultant product and results in solidification with little oxidation. These are significant advantages.

The features and advantages of the present invention will be more readily apparent from a consideration of the following illustrative examples.

EXAMPLE I

Preparation of Master Alloy

The following example is an example of the process for preparing the master alloy of the present invention. In this example, the strontium contents were between 20–80%, with the strontium, zinc, aluminum and copper contents as set forth in the following examples.

The required quantity of zinc was melted down in a furnace and from 0.01–2.0% of aluminum or copper was added to the melt. The furnace temperature was adjusted to approximately 540° C. A gas cover was applied to the furnace using an inert gas to further protect the melt from excessive oxidation and dross generation. The required amounts of strontium metal was added to the melt slowly and incrementally and the melt was stirred to insure homogeneity. The furnace temperature was adjusted to approximately 650° C. The resultant master alloy was cast into the desired product form, e.g., shot, button, ingot, etc.

The master alloy of the preferred composition is brittle and may be further processed into powder or granules using conventional methods. Similarly, the powder or granules may be further processed into compacts or briquettes or cored wire or rod product forms.

Alternatively, a portion of the zinc content may if desired be retained and added at the end of the alloying sequence to quench the melt to casting temperatures.

EXAMPLE II

Bulk Dissolution Rate of Sr—Zn—X Master Alloy in 12.5% Si—Al Alloy

The method previously described in Example I was used to produce a series of Sr—Zn—X alloys of the present invention to evaluate their respective bulk dissolution rates. Tests were conducted in a 12.5% Si—Al alloy at a temperature of 625–650° C. Representative specimens of each master alloy were placed into a cage which was then plunged beneath the surface of the melt. The cage was periodically withdrawn and visually inspected to determine the degree of dissolution which had occurred. In addition to the Sr—Zn—X master alloy compositions, existing commercial binary strontium master alloys and pure metallic strontium were included for comparison. Products and chemical compositions evaluated and time required for dissolution are given in Table I.

TABLE I

| Chemical Composition of Alloys (Wt. %) | | | | | | | Bulk Dissolution Time (Minutes) |
|---|---|---|---|---|---|---|---|
| Test | Master Alloy | Sr | Zn | Al | Cu | Si | Dissolution Time-Comments |
| (1) | Commercial | 10 | — | 90 | — | — | No significant dispersion after 30 minutes |
| (2) | Commercial | 10 | — | 76 | — | 14 | NO significant dispersion after 30 minutes |
| (3) | Commercial | 90 | — | 10 | — | — | No significant dispersion after 30 minutes |
| (4) | Strontium Metal | 100 | — | — | — | — | No significant dispersion after 30 minutes |
| (5) | Zr—Sr—X | 35 | 64 | 0.1 | — | — | 1-Bulk gone, semi solid dispersion |
| (6) | Zr—Sr—X | 55 | 45 | 0.2 | — | — | 2-Bulk gone, semi solid dispersion |
| (7) | Zr—Sr—X | 62 | 38 | 0.2 | — | — | 2-Bulk gone, semi solid dispersion |
| (8) | Zr—Sr—X | 68 | 32 | 0.3 | — | — | 2-Bulk gone, semi solid dispersion |
| (9) | Zr—Sr—X(1) | 72 | 28 | 0.5 | — | — | 5-Bulk gone, semi solid dispersion |
| (10) | Zr—Sr—X(2) | 35 | 63 | — | 1.9 | — | 2-Bulk gone, semi solid dispersion |

Notes:
( ) indicates approximate value.
(1)plus 0.0015% Be.
(2)plus 0.1% Be.

EXAMPLE III

Sr—Zn Master Alloy Performance as a Modifier of Eutectic Silicon in a 12.5% Si—Al Alloy A Sr—Zn master alloy of the present invention containing 33 weight percent strontium, 67 weight percent zinc was produced in accordance with the method of Example I. A 12.5 weight percent silicon, balance aluminum alloy was prepared in the laboratory and heated to a temperature of 650° C. in a resistance furnace. The above master alloy was added to the Si—Al melt in an amount calculated to contribute a strontium addition of 0.02 weight percent. After holding the Al—Si melt for 2 minutes, a specimen was cast into a preheated cylindrical steel mold and evaluated for the degree of eutectic silicon modification using conventional metallographic techniques. The procedure was repeated using Sr—Zn master alloys of the present invention containing 34 and 35 weight percent strontium. Each of the above Sr—Zn compositions produced a fully modified and fibrous eutectic silicon structure.

EXAMPLE IV

Sr—Zn Master Alloy Performance as a Modifier of Eutectic Silicon in Al-Si-Cu-Zn Alloy Die Castings A 35 weight percent strontium, 65 weight percent zinc master alloy of the present invention was produced in the form of a 130 gram button in accordance with the method of Example I and evaluated as a modifier in an Al—Si—Cu—Zn die casting alloy. The procedure consisted of adding the master alloy to a molten metal transfer crucible containing an Al—Si alloy having a nominal chemical composition of 9.5 weight percent silicon, 2.9 weight percent copper, 2.4 weight percent zinc, 1.0 weight percent iron, 0.3 weight percent magnesium, balance aluminum. Molten metal temperature in the transfer crucible was 670° C. Following addition of the master alloy, the molten metal in the transfer crucible was fluxed and degassed. This cycle consisted of 2 minutes of flux injection, followed by 1 minute of rotary degassing using argon, for a total cycle time of 3 minutes during which the molten metal temperature decreased to 650° C. The molten metal was then transferred to the holding furnace of a cold chamber die casting machine.

Castings produced were examined using conventional metallographic techniques to evaluate the degree of eutectic silicon modification obtained. The eutectic silicon phase was found to be fully modified and exhibited a fibrous eutectic silicon structure. Strontium content in the castings ranged from 0.007 to 0.010 weight percent.

EXAMPLE V

Sr—Zn Master Alloy Performance as a Modifier of Eutectic Silicon Al—Zn—Si; Steel Coating Alloy Strontium additions to Al—Zn—Si coating lines using conventional master alloys is not possible due to the low molten metal temperature of the coating bath, which is typically maintained at around 600° C.

To evaluate the performance of the Sr—Zn master alloy, an Al—Zn—Si alloy containing 57.5 weight percent aluminum, 41 weight percent zinc and 1.5 weight percent silicon, was prepared in the laboratory. The Al—Zn—Si alloy was maintained at a temperature of 600° C. in a resistance furnace. A 29 weight percent strontium, 71 weight percent zinc master alloy of the present invention produced in accordance with the method of Example I was added to the Al—Zn—Si melt in an amount calculated to contribute a strontium addition of 0.005 weight percent. After holding the Al—Zn—Si melt for 5 minutes, specimens were cast and evaluated for the degree of eutectic silicon modification. This was repeated with master alloy additions calculated to contribute strontium additions of 0.01 and 0.02 weight percent.

Metallographic examination of the resulting microstructure revealed that prior to the master alloy addition, the eutectic silicon exhibited an acicular, sharp needle-like morphology; typical of an unmodified structure. Following additions of the above master alloy, the acicular characteristics of the eutectic silicon began to break up and become more fibrous in structure. Full modification of the eutectic silicon was obtained at addition levels of 0.01–0.02 weight percent strontium.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method for modifying the microstructure of nonferrous alloys, which comprises: providing a melt of an alloy selected from the group consisting of aluminum base alloys, magnesium base alloys and zinc base alloys; and adding thereto a master alloy consisting essentially of in weight percent 20–80% strontium, with the balance being zinc plus impurities.

2. A method according to claim 1, wherein said master alloy includes in weight percent 0.01 to 2.0% each of a material selected from the group consisting of aluminum, copper and mixtures thereof.

3. A method according to claim 1, wherein said melt is an aluminum-silicon casting alloy containing a eutectic component, including the step of modifying the eutectic component by the addition of said master alloy to said aluminum-silicon casting alloy to produce a fine, fibrous microstructure.

4. A method according to claim 1, including the step of adding said master alloy to a molten metal bath of an aluminum base casting or wrought alloy to modify the microstructure thereof.

5. A method according to claim 1, including the step of adding said master alloy to a molten metal bath of an aluminum base casting alloy containing an Fe-bearing intermetallic phase to reduce the size of said intermetallic phase.

6. A method according to claim 1, including the step of adding said master alloy to a molten metal bath of a magnesium base alloy to reduce the grain size and concentrating shrinkage microporosity.

7. A method according to claim 1, including the step of adding said master alloy to a molten metal bath of an aluminum base casting alloy containing plate-shape beta $Al_5FeSi$ phase to modify said plate-shape beta phase to Chinese scrip alpha $Al_8Fe_2Si$ phase.

8. A method according to claim 1, including the step of adding said master alloy to a molten metal bath of an aluminum base alloy containing $Mg_2Si$ phase to modify said $Mg_2Si$ phase from Chinese scrip to needle-shape form.

9. A method according to claim 1, wherein said melt is maintained at a temperature no greater than 660° C.

10. A method according to claim 1, wherein said melt is maintained at a temperature no greater than 600° C.

11. A method according to claim 2, including providing from 0.1 to 0.5% each of said material.

12. A method according to claim 1, including providing from 30 to 40% strontium.

* * * * *

UNITED STATES PATENT AND TRADEMARK OFFICE

CERTIFICATE OF CORRECTION

PATENT NO. : 6,042,660
DATED : March 28, 2000
INVENTOR(S) : GARY W. BOONE ET AL.

It is certified that error appears in the above-identified patent and that said Letters Patent is hereby corrected as shown below:

In Column 5, Table I, line 12, "Zr-Sr-X" should read --Zn-Sr-X--;

In Column 5, Table I, line 13, "Zr-Sr-X" should read --Zn-Sr-X--;

In Column 5, Table I, line 14, "Zr-Sr-X" should read --Zn-Sr-X--;

In Column 5, Table I, line 15, "Zr-Sr-X" should read --Zn-Sr-X--;

In Column 5, Table I, line 16, "Zr-Sr-X" should read --Zn-Sr-X--; and

In Column 5, Table I, line 17, "Zr-Sr-X" should read --Zn-Sr-X--.

Signed and Sealed this

Sixth Day of February, 2001

*Attest:*

*Attesting Officer*

Q. TODD DICKINSON

*Director of Patents and Trademarks*